US007946831B2

(12) United States Patent
Roller et al.

(10) Patent No.: US 7,946,831 B2
(45) Date of Patent: May 24, 2011

(54) COMPRESSOR FOR REFRIGERANT

(75) Inventors: Dieter Roller, Aidlingen (DE); Gernot Balz, Schoenaich (DE); Thomas Varga, Aidlingen (DE)

(73) Assignee: Bitzer Kuehlmaschinenbau GmbH (DE)

( * ) Notice: Subject to any disclaimer, the term of this patent is extended or adjusted under 35 U.S.C. 154(b) by 1220 days.

(21) Appl. No.: 11/524,228

(22) Filed: Sep. 20, 2006

(65) Prior Publication Data

US 2007/0077161 A1 Apr. 5, 2007

(30) Foreign Application Priority Data

Sep. 30, 2005 (DE) ..... 10 2005 048 093

(51) Int. Cl.
*F04B 39/02* (2006.01)

(52) U.S. Cl. ..... 417/368; 417/366; 417/370; 417/371; 417/902; 418/55.6

(58) Field of Classification Search ..... 417/366, 417/368, 370, 371, 410.5, 902; 418/55.6
See application file for complete search history.

(56) References Cited

U.S. PATENT DOCUMENTS

| | | | | |
|---|---|---|---|---|
| 4,743,181 | A | 5/1988 | Murayama et al. | |
| 5,829,959 | A | 11/1998 | Tsubono et al. | |
| 6,050,794 | A * | 4/2000 | Noboru et al. | 418/55.6 |
| 6,086,343 | A * | 7/2000 | Sun et al. | 418/55.6 |
| 6,672,101 | B2 | 1/2004 | Gennami et al. | |
| 6,896,493 | B2 * | 5/2005 | Chang et al. | 417/410.5 |
| 2002/0136652 | A1 | 9/2002 | Gennami et al. | |
| 2002/0136653 | A1 | 9/2002 | Gennami et al. | |
| 2004/0126261 | A1 * | 7/2004 | Kammhoff et al. | 418/55.6 |
| 2007/0092391 | A1 * | 4/2007 | Elson et al. | 418/55.6 |

FOREIGN PATENT DOCUMENTS

| | | |
|---|---|---|
| DE | 102 13 252 | 1/2003 |
| EP | 0 809 029 | 11/1997 |
| EP | 0 969 210 | 1/2000 |
| EP | 1 308 328 | 5/2003 |
| EP | 1 319 840 | 6/2003 |

* cited by examiner

*Primary Examiner* — Devon C Kramer
*Assistant Examiner* — Leonard J Weinstein
(74) *Attorney, Agent, or Firm* — Reinhart Boerner Van Deuren P.C.

(57) ABSTRACT

To improve a compressor for refrigerant, comprising an outer casing, a scroll compressor disposed in the outer casing, a drive unit, disposed in the outer casing, for the second compressor body, having an eccentric drive, a drive shaft running in lying arrangement or approximately horizontally in the outer casing and a drive motor, which includes a stator and a rotor seated on the drive shaft, as well as a lubricant supply, in such a manner that the minimum possible quantity of lubricant is required, it is proposed that a lubricant collection space is disposed in the outer casing, that the lubricant supply has a delivery wheel which delivers lubricant from a delivery sump into a feed space for the drive shaft, and that a lower pressure prevails in a lubricant delivery space accommodating the delivery sump than in the lubricant collection space, so that the lubricant which collects in the lubricant space, on account of the pressure difference, passes into the delivery sump.

31 Claims, 10 Drawing Sheets

COMPRESSOR FOR REFRIGERANT

CROSS-REFERENCE TO RELATED PATENT APPLICATIONS

This patent application claims the benefit of German Application No. 10 2005 048 093.4, filed Sep. 30, 2005, the teachings and disclosure of which are hereby incorporated in its entirety by reference thereto.

BACKGROUND OF THE INVENTION

The invention relates to a compressor for refrigerant, comprising an outer casing, a scroll compressor, which is disposed in the outer casing and has a first compressor body disposed in a fixed position in the outer casing and a second compressor body that can move relative to the first compressor body, which compressor bodies each have a base and first or second scroll fins, respectively, which project above the respective base and engage into one another in such a way that to compress the refrigerant the second compressor body is movable with respect to the first compressor body on an orbital path about the center axis, a drive unit, disposed in the outer casing, for the second compressor body, having an eccentric drive, a drive shaft running in lying arrangement in the outer casing and a drive motor, which includes a stator and a rotor seated on the drive shaft, as well as a lubricant supply.

Compressors of this type are known from the prior art.

The problem with this prior art is that the fact that the drive shaft is disposed in lying arrangement means that a large quantity of lubricant is required in order for the lubricant supply to be maintained in all operating situations.

Therefore, the invention is based on the object of improving a compressor of the type described in the introduction in such a manner as to minimize the quantity of lubricant required.

SUMMARY OF THE INVENTION

According to the invention, this object is achieved, in a compressor of the type described in the introduction, by virtue of the fact that a lubricant collection space is disposed in the outer casing, in that the lubricant supply has a delivery wheel which delivers lubricant from a delivery sump into a feed space for the drive shaft, and in that a lower pressure prevails in a lubricant delivery space accommodating the delivery sump than in the lubricant collection space, so that the lubricant which collects in the lubricant collection space, on account of the pressure difference, passes into the delivery sump.

The advantage of the solution according to the invention is that the quantity of lubricant in the delivery sump does not entirely have to be ensured by a correspondingly large quantity of lubricant, but rather all the accumulations of lubricant in the lubricant collection space are induced, with the aid of the pressure difference between the lubricant collection space and the lubricant delivery space, to pass into the delivery sump of the lubricant collection space and to collect there in order to be delivered into the feed space by the delivery wheel of the lubricant supply.

This allows the quantity of lubricant required for a compressor of this type to be reduced considerably.

The reduction in the quantity of lubricant has all the associated advantages, in particular also reducing the problem of degassing the lubricant when starting up the compressor, which is dependent on the quantity of lubricant.

No further details have hitherto been given as to the way in which the lubricant supply is arranged in the compressor according to the invention. A particularly advantageous solution provides that the lubricant supply is disposed on the opposite side of the drive motor from the scroll compressor.

To enable the lubricant delivery space to be provided in a form which is as uncomplicated as possible, it is advantageous if the lubricant delivery space is disposed between a partition in the outer casing and an end wall of the outer casing.

It is likewise the case that hitherto no further details have been given as to the arrangement of the feed space. By way of example, the feed space could be disposed close to or on the partition.

However, according to a particularly advantageous solution in structural terms, the feed space for the lubricant supply is disposed at an end wall of the outer casing.

A solution which is particularly simple in terms of manufacturing technology provides that the feed space is at least partially formed into the end wall.

Equally, no further details have been given as to the way in which the delivery sump is formed. It is in this context particularly advantageous if the delivery sump is enclosed by an end wall of the outer casing and by the partition, i.e. is enclosed between these two components. Therefore, no additional measures are required to form the delivery sump in the lubricant delivery space.

A particularly simple configuration of the compressor according to the invention provides that the delivery sump is disposed between that end wall of the outer casing which carries the feed space and the partition.

Hitherto, no further details have been provided as to the way in which the lubricant is transferred from the lubricant collection space into the delivery sump.

A particularly simple and inexpensive solution provides that the partition has a passage for lubricant to pass from the lubricant collection space into the delivery sump.

The passage can be formed in a very wide range of ways. An advantageous solution provides that the passage comprises a lubricant-receiving tube which is directed to a base side of the lubricant collection space. This creates the possibility, in a particularly simple way, of receiving lubricant directly above the base side of the lubricant collection space and directing it to the delivery sump.

Advantageously, the lubricant collection tube extends as far as a central region of the lubricant collection space, so that it is ensured that lubricant collecting in the lubricant collection space is received with even just a slight inclination of the drive shaft with respect to a horizontal.

In this context, it is preferable for a base side of the lubricant collection space to run approximately parallel to a center axis of the drive shaft.

To allow even extremely small quantities of lubricant to be received on the base side of the lubricant collection space, it is preferably provided that the lubricant collection tube has an inlet opening which faces the base side and is in particular disposed at a short distance from the base side.

Hitherto, no further details have been provided with regard to the features of the delivery wheel; a particularly advantageous solution provides that the delivery wheel has an edge region extending transversely with respect to a disk plane of the delivery wheel.

In this case, the edge region is preferably of channel-like form, in order to hold the lubricant for as long as possible and to discharge it into a centrifugal space of the lubricant delivery space, from which it is then passed via catcher walls to the feed space.

No further details have been provided with regard to the integration of the partition into the rest of the structure of the compressor according to the invention. Thus, a particularly advantageous solution provides that the partition carries a bearing unit of the drive motor, and therefore represents an integral part of the compressor as a whole.

Hitherto, no further details have been provided as to the separation of lubricant which is entrained by the refrigerant. An advantageous solution provides that a lubricant separation space through which the sucked-in refrigerant flows before it enters the scroll compressor, is provided in the outer casing, so that the lubricant can be at least substantially separated from the refrigerant in the lubricant separation space.

It is in this context particularly advantageous if the lubricant separation space is disposed between the drive motor and the outer casing, and can therefore be accommodated in a structurally simple way in the outer casing.

Furthermore, no statements have been given, in the context of the explanation of the individual embodiments given thus far, with regard to the cooling of the drive motor. The drive motor can be cooled in a very wide range of ways; by way of example, it is conceivable for the drive motor to be cooled by the refrigerant, which has been compressed to a high pressure.

Another advantageous solution provides for the drive motor to be cooled by refrigerant which has been sucked in.

In any event, it is advantageously provided that the drive motor is provided with a flow-guiding jacket which directs refrigerant through the drive motor for cooling purposes.

With regard to the cooling action, it is particularly advantageous if refrigerant that has been sucked in and is to be compressed enters a motor inner space surrounded by the flow-guiding jacket.

It is in this context particularly advantageous if the refrigerant emerges from the flow-guiding jacket into a lubricant separation space, so that lubricant can be separated out after it has flowed through the drive motor.

For this purpose, it is advantageously provided that the lubricant separation space is disposed between the flow-guiding jacket and the outer casing.

It is likewise the case that no further details have been given as to the way in which the lubricant collection space is arranged. An advantageous solution provides that the lubricant collection space is disposed between the drive motor and the outer casing.

A solution in which the lubricant collection space is disposed in an intermediate space between the flow-guiding jacket of the drive motor and the outer casing, is particularly suitable in structural terms.

The combination of the lubricant separation with the collection of the lubricant can be realized in a particularly advantageous way if the lubricant separation space is disposed in the intermediate space between the flow-guiding jacket and the outer casing, above the lubricant collection space with regard to the direction of the force of gravity.

No further details have been given, in the context of the explanation provided thus far of the individual exemplary embodiments, with regard to the further directing of the refrigerant that is to be compressed. A particularly advantageous solution provides that the refrigerant passes from the lubricant collection space into a suction space of the scroll compressor.

A particularly advantageous solution provides that a lower static pressure prevails in a suction space of the scroll compressor than in the lubricant collection space.

A pressure gradient of this type is formed, for example, by a narrowing of the cross section of flow when the refrigerant passes from the lubricant separation space into the suction space; by way of example, a static pressure in the lubricant separation space approximately corresponding to a pressure in the lubricant collection space.

A pressure gradient of this type between the lubricant collection space and the suction space can be used in particular to generate a static pressure difference between the lubricant collection space and the lubricant delivery space.

For this reason, it is preferably provided that a connecting line leads from the suction space of the scroll compressor to the lubricant delivery space. This connecting line effects pressure equalization between the lubricant delivery space and the suction space, so that the static pressure in the lubricant delivery space is approximately equal to the static pressure in the suction space, if appropriate slightly higher than this pressure, but preferably is always lower than the static pressure in the lubricant collection space.

In structural terms, a connecting line of this type can be realized in a particularly simple way if the connecting line is directed through the lubricant separation space.

Thus far, no further details have been provided as to the mounting of the drive unit and the drive motor. A particularly advantageous solution provides that the drive unit is supported in a bearing unit which is embodied between the scroll compressor and the drive motor.

In this case, the bearing unit is advantageously configured in such a way that it is supported in the outer casing.

To allow refrigerant to flow to the scroll compressor, it is preferable for the bearing unit to be formed in such a way that through-openings for the refrigerant to be passed from the lubricant separation space into the suction space of the scroll compressor are provided in the bearing unit.

Furthermore, an advantageous exemplary embodiment of the compressor according to the invention is advantageously constructed in such a way that the drive shaft is supported by a second bearing unit which is disposed on the opposite side of the drive motor from the first bearing unit.

A solution in which the lubricant separation space is located between the bearing units is in this context may be effected particularly advantageously in structural terms.

Furthermore, an advantageous structural solution provides that the lubricant collection space is located between the bearing units.

Further features and advantages of the invention form the subject matter of the following description and of the illustration of an exemplary embodiment in the drawing.

DETAILED DESCRIPTION OF THE INVENTION

Figure 1:
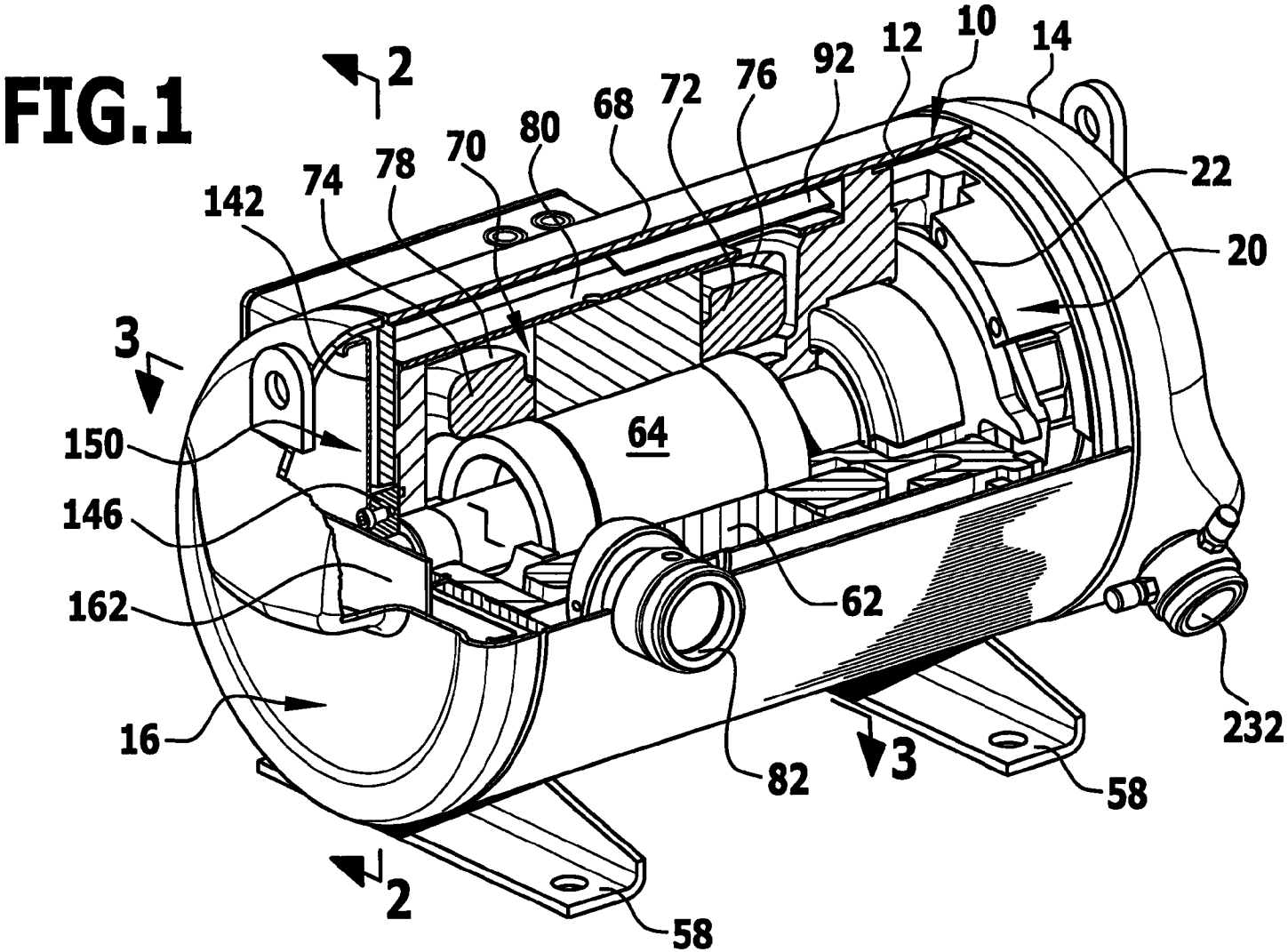
FIG. 1 shows a perspective, partially sectioned illustration of a first exemplary embodiment of a compressor according to the invention.
Figure 2:
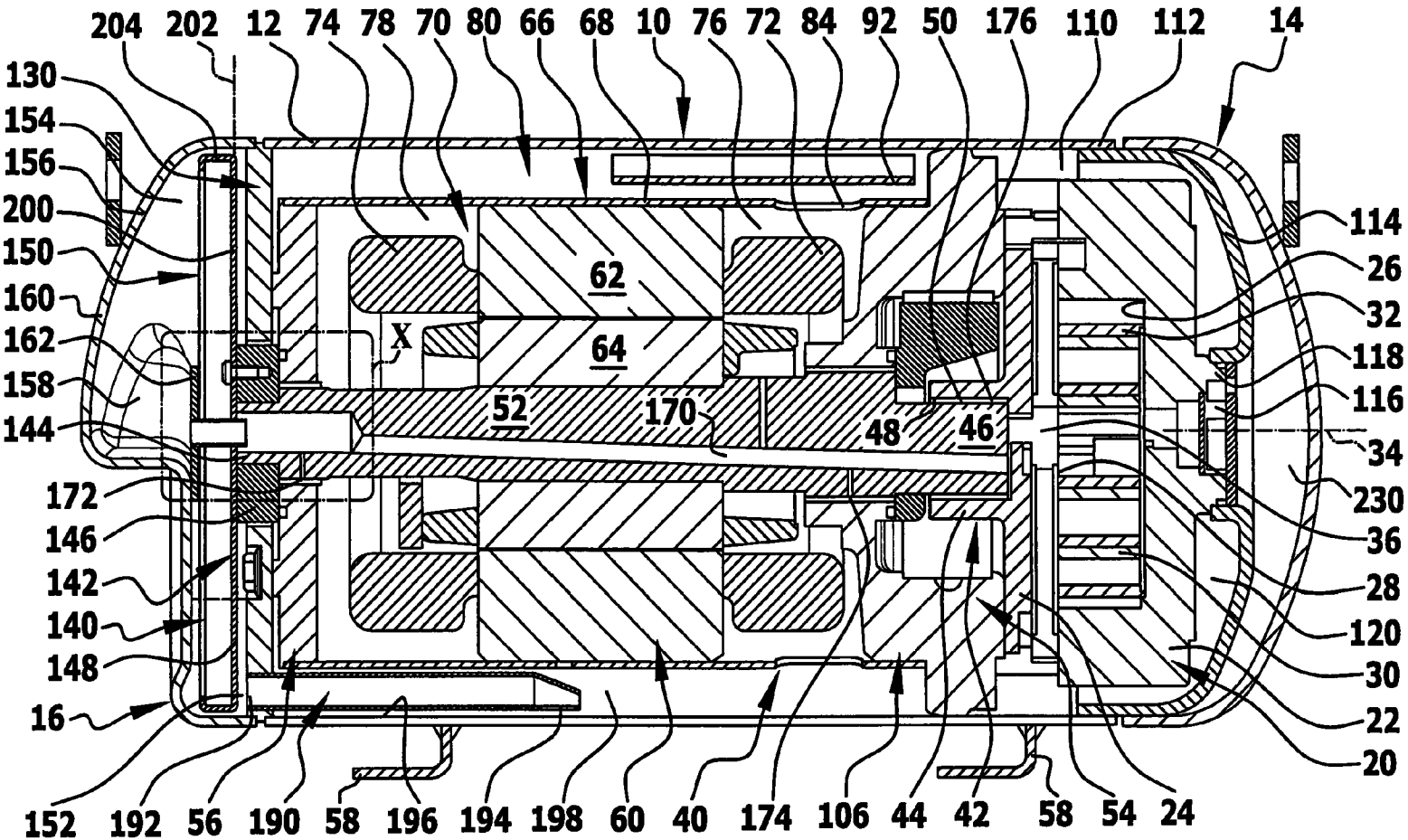
FIG. 2 shows a section on line 2-2 in FIG. 1.

A first exemplary embodiment of a compressor according to the invention, which is illustrated in FIGS. 1 and 2, comprises an outer casing, which is designated overall by 10 and comprises a substantially cylindrical shell 12, which is closed off by a first cover 14 in the region of a first end and by a second cover 16 in the region of a second end.

A scroll compressor, which is designated overall by 20 and includes a first compressor body 22, disposed in a fixed position in the outer casing 10 and a second compressor body 24, disposed moveably in the outer casing 10, is provided in the outer casing 10, on a side facing the first cover 14; the compressor bodies each have scroll fins 30 and 32, respectively, which project above a base 26 or 28, respectively, these fins engaging in one another in such a way that to compress refrigerant the second compressor body 24 is movable with respect to the first compressor body 22 on an orbital path about a center axis 34.

Furthermore, the second compressor body 24 is also guided relative to the first compressor body 22, disposed in a stationary position, by a known Oldham Coupling 36.

The scroll compressor 20 is driven by a drive unit, which is designated overall by 40 and comprises an eccentric receiver 44, which is fixedly connected to the second compressor body 24, preferably formed integrally on it, and on which an eccentric 46 that rotates about the center axis 34 engages in order to move the second compressor body 24 on the orbital path about the center axis 34.

It is preferable for the eccentric 46 to engage in a bore 48 formed by the eccentric receiver 44 and to bear against said bore by way of outer lateral surfaces 50. However, it is also conceivable for the eccentric 46 to engage around the eccentric receiver 44.

The eccentric 46 is formed on a drive shaft, which is designated overall by 52, is mounted rotatably coaxially with respect to the center axis 34 and runs in lying arrangement or approximately horizontally. For this purpose, the drive shaft 52 is mounted in a first bearing unit 54 facing the scroll compressor 20 and on an opposite side in a second bearing unit 56 facing the second cover 16.

Both bearing units 54 and 56 are supported directly or indirectly on the outer casing 10 and hold the drive shaft 52 in lying arrangement or substantially horizontally when the outer casing 10 has been fitted or mounted in accordance with mounting elements 58 provided thereon.

In particular, in the exemplary embodiment illustrated, the shell 12 likewise extends approximately parallel, in particular coaxially, to the center axis 34, which likewise runs in lying arrangement.

The drive shaft 52 is driven by a drive motor, which is designated overall by 60 and comprises a stator 62 disposed between the bearing units 54 and 56 and a rotor 64 disposed between the bearing units 54 and 56, the rotor 64 being seated directly on the drive shaft 52 and being supported by the latter such that it can rotate about the center axis 34.

Furthermore, the stator 62 is held in a motor casing 66, which comprises a gas-guiding shell 68 which is supported on the bearing units 54 and 56 and carries the stator 62.

The gas-guiding shell 68 surrounds a motor inner space 70, which in the region of a first winding head 72 and of a second winding head 74, has a first flow-around space 76 and a second flow-around space 78, respectively, the first flow-around space 76 being located on that side of the motor inner space 70 which faces the first bearing unit 54, and the second flow-around space 78 being located on a side of the motor inner space 70 which faces the second bearing unit 56.

Furthermore, the gas-guiding shell 68 runs at a spacing from the shell 12, so that an intermediate space 80, which surrounds the motor casing 66, is formed between the shell 12 of the outer casing 10 and the gas-guiding shell 68 of the drive motor 60.

The drive motor 60 is now cooled by refrigerant that is to be compressed and has been sucked in via a suction connection piece 82 of the compressor being fed directly to the motor inner space 70, for example in the region of the second flow-around space 78, thereby cooling the second winding heads 74, then at least partially passing through a gap between the rotor 64 and the stator 62 and entering the first flow-around space 76, in which the first winding heads 72 are cooled. The refrigerant which has been sucked in then passes from the first flow-around space 76, out of the motor casing 66, preferably via an aperture 84 provided in the gas-guiding shell 68, and enters the intermediate space 80.

Figure 5:
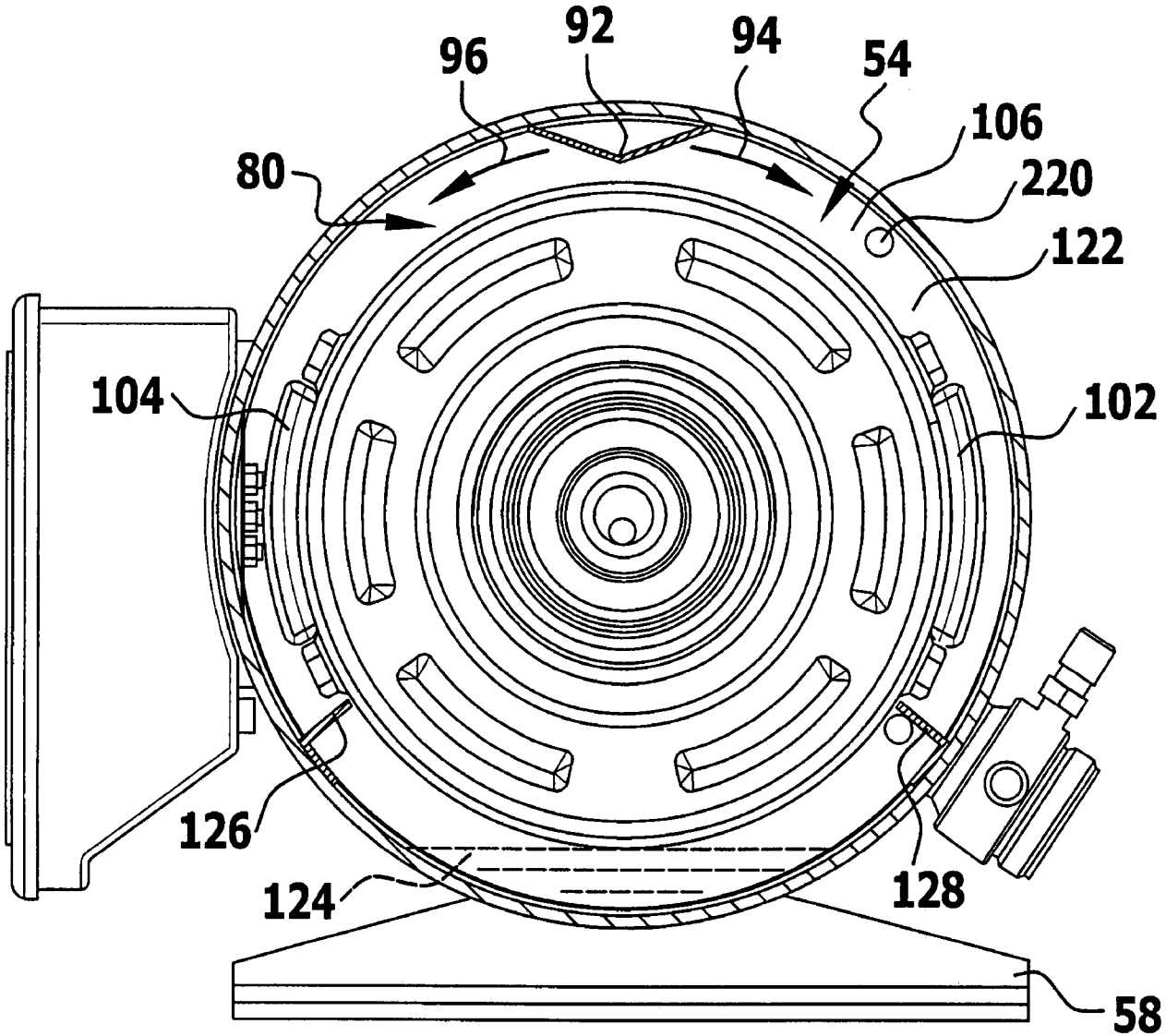
FIG. 5 shows a section on line 5-5 in FIG. 3.

As soon as the refrigerant that has been sucked in enters the motor inner space 70, it is preferable for it to be diverted into two opposite azimuthal directions 86 and 88 with respect to the center axis 34, by means of a flow diverter element 90, and when the refrigerant that has been sucked in leaves the inner space 70 via the aperture 84, it is also preferable for it to be diverted in two azimuthal directions 94 and 96, which are in the opposite direction with respect to the center axis 34, by means of a flow diverter element 92 provided in an intermediate space 80, along which azimuthal directions 94 and 96 the refrigerant then flows in the intermediate space 80, specifically, as illustrated in FIG. 5, to through-openings 102 and 104 which are provided in an outer flange region 106 of the first bearing unit 54 and through which the refrigerant which has been sucked in can enter a suction space 110, which is located on a side of the first bearing unit 54 facing the scroll compressor 20.

Moreover, the suction space 110 is also surrounded by an end region 112, facing the first cover 14, of the shell 12 and a convex intermediate base 114, which engages over the first compressor body 22, carries the latter and extends from the end region 112 of the shell 12 to an annular body 118 of the first compressor body 22, surrounding a high-pressure outlet 116 of the first compressor body 22, so that a flow space 120, which extends as far as the annular body 118, remains between the first compressor body 22 and the intermediate base 114, which flow space 120 allows cooling of the first compressor body 22 on its side remote from the first scroll fins 30.

The intermediate space 80 serves, by way of its region located between the flow-diverter element 92 and the through-openings 102 and 104, as a lubricant separation space 122, the lubricant which is separated out, in the intermediate space 80, being collected, in accordance with the force of gravity, in a lubricant collection space 124 located beneath the lubricant separation space 122.

To prevent lubricant from being swirled up in the lubricant collection space 124, the lubricant collection space 124 is additionally shielded from the lubricant separation space 122 by shielding elements 126 and 128, preventing refrigerant that has been sucked in from flowing in, without the shielding elements 126 and 128 preventing the lubricant from entering the lubricant collection space 124.

The lubricant collection space 124 is located in a lower region, with regard to the direction of the force of gravity, of the intermediate space 80, preferably on a side facing the mounting elements 58.

Overall, the intermediate space 80 extends between the outer flange region 106 of the first bearing unit 54 and a partition 130 which carries the second bearing unit 56, these parts both extending in the radial direction with respect to the center axis 34 as far as the shell 12 and ending in a substantially sealed manner at the latter.

On a side of the partition 130 which is remote from the drive motor 66 there is provided a lubricant supply, which is designated overall by 140 and comprises a delivery wheel 142 which has a hub 146, which is seated on one end 144 of the drive shaft 52 and on which is held a delivery disk 148 extending radially.

The delivery disk 148 extends in a lubricant delivery space 150, which is located between the partition 130 and the second cover 16 and comprises a delivery sump 152, in which lubricant that is to be delivered collects, and a centrifugal space 154, in which lubricant that has been received from the delivery sump 152 by the delivery wheel 142 is thrown off, the centrifugal space 154 preferably being located on a side of the lubricant delivery space 150 which is remote from the delivery sump 152, as seen in the direction of the force of gravity.

At least in a partial region, the centrifugal space 154 is provided with catcher walls 156 for the lubricant, which collect the latter and pass it into a feed space 158, from which the lubricant can then be fed to the drive shaft 52.

It is preferable for the cover 16 to be provided with a curvature 160, which on the one hand forms the catcher walls 156 and on the other hand, in its region facing the center axis 34, partially surrounds the feed space 158, this feed space 158 additionally also being formed by a boundary wall 162 located between a lower region of the curvature 160 and the delivery disk 148, so that the lubricant can enter the feed space 158 from catcher walls 156 which extend above the feed space 158 with regard to the direction of the force of gravity.

Figure 6:
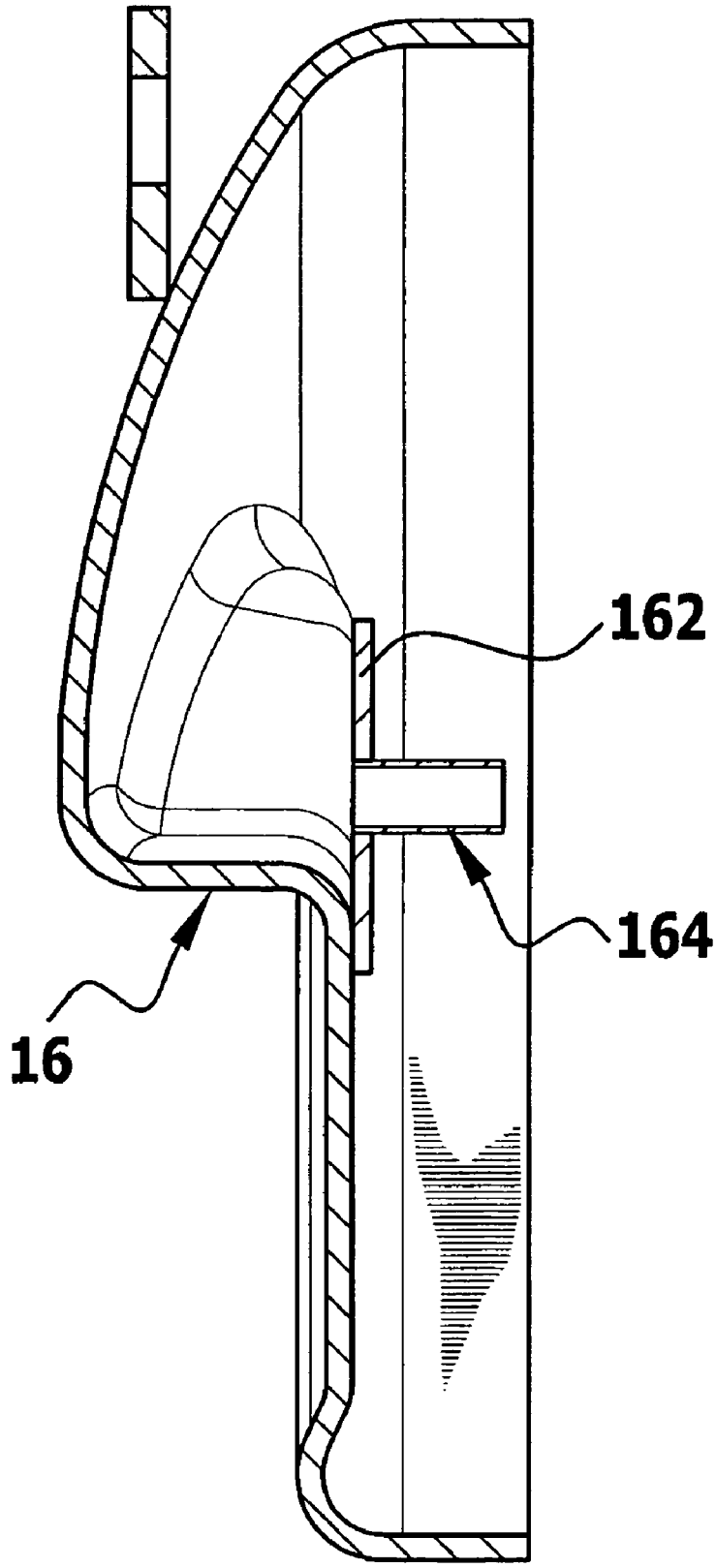
FIG. 6 shows an enlarged illustration of a second cover of an outer casing as shown in FIG. 1.
Figure 7:
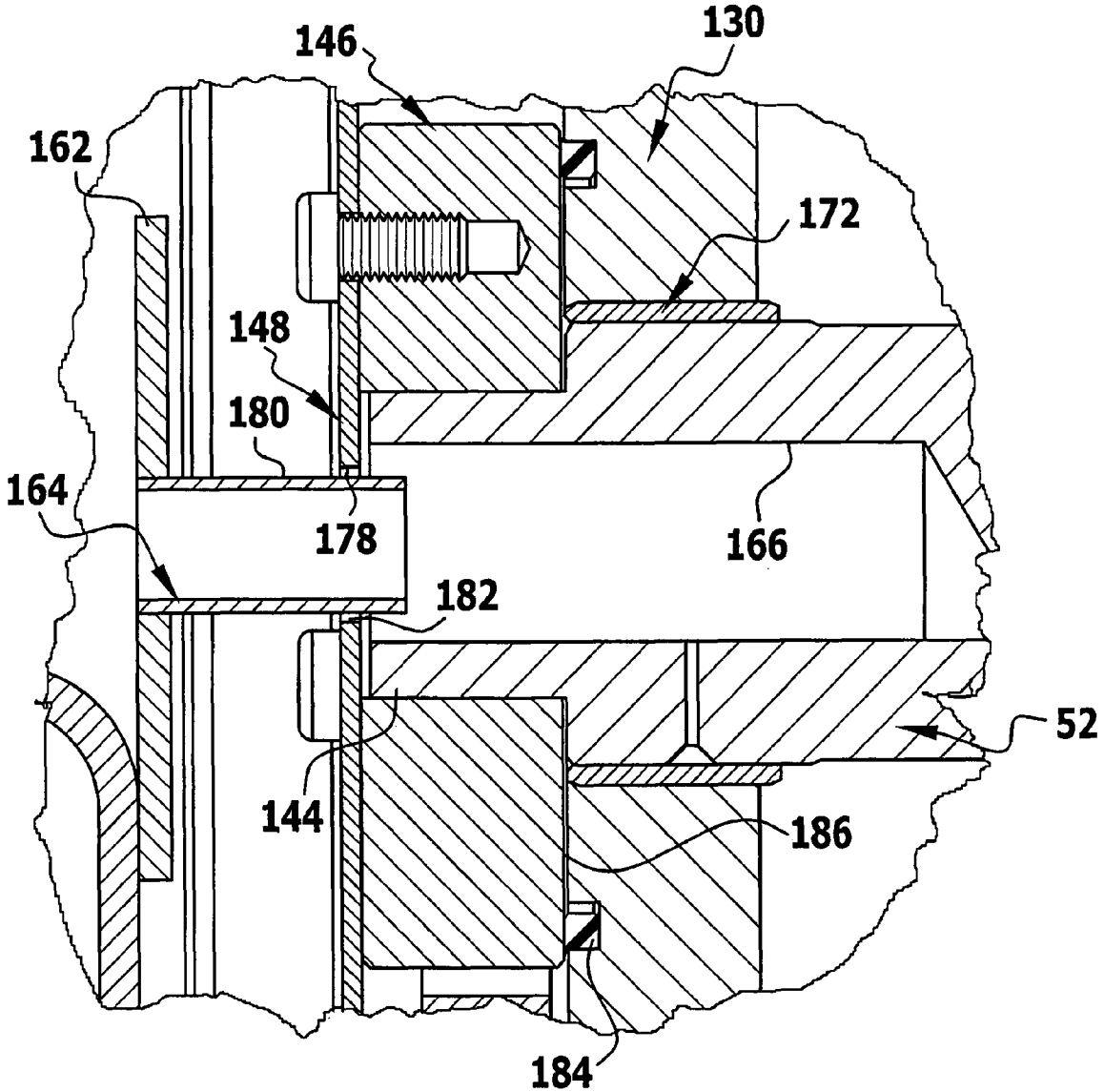
FIG. 7 shows an enlarged illustration of a region X in FIG. 2.

As illustrated in FIGS. 6 and 7, an outlet tube 164, which is disposed coaxially with respect to the center axis 34, extends in the direction of the end 144 of the drive shaft 52 and projects into a lubricant-receiving bore 166 in the end 144 of the drive shaft 52, is seated in the boundary wall 162.

As illustrated in FIG. 2, the lubricant-receiving bore 166 is adjoined by a lubricant delivery channel 170, which penetrates through the drive shaft 52 from the end 144 as far as the eccentric journal 46, runs obliquely with respect to the center axis 34 and, when the drive shaft 52 is rotating, on account of centrifugal force, delivers lubricant out of the lubricant-receiving bore 166 in order to lubricate a bearing 172 by which the drive shaft 52 is mounted in the second bearing unit 56, to lubricate a bearing 174, by which the drive shaft 52 is mounted in the first bearing unit 54, and to lubricate a bearing 176 which is provided between the eccentric 46 and the eccentric receiver 44.

To ensure that as little lubricant as possible is lost from the lubricant-receiving bore 166, the delivery disk 148 is formed in such a way that its central opening 178 extends virtually as far as an outer lateral surface 180 of the outlet tube 164, so that only a narrow gap 182 is formed between the outer lateral surface 180 of the outlet tube 164 and the central opening 178, through which gap only a small quantity of lubricant can emerge from the lubricant-receiving bore 166 into the lubricant delivery space 150.

In order also to obtain as sealed a closure as possible between the hub 146 of the delivery wheel 142 and the partition 130, it is preferable for a seal 184 also to be fitted into the partition 130, which seal 184 acts between the partition 130 and a rear side 186, facing the partition 130, of the hub 146.

Overall, therefore, the lubricating-oil delivery space 150 is substantially closed off from the intermediate space 80 and the motor inner space 70.

For lubricant to be transferred from the lubricant collection space 124 into the lubricant delivery space 150 and to form the delivery sump 152, a lubricant-receiving tube 190 is provided, which tube penetrates through the partition 130 and on one side opens out, by way of an opening 192, into the lubricant delivery space 150 in the region of the delivery sump 152, and on the other side opens out by way of an opening 194 into the lubricant collection space 124, specifically in the region close to an inner surface, forming a base side 196 of the lubricant collection space 124, of the outer casing 12, in order to receive lubricant that collects above this base side 196, the base side 196 running approximately parallel to the center axis 34 of the drive shaft 52 and representing the deepest point of the lubricant collection space 124.

The lubricant-receiving tube 190 extends substantially as far as a region 198 which is located approximately centrally between the partition 130 and the outer flange region 106 of the first bearing unit 54, in order to enable the lubricant which collects in the lubricant collection space 124 to be received via the opening 194 even when the base side 196 is inclined with respect to the horizontal.

Figure 8:
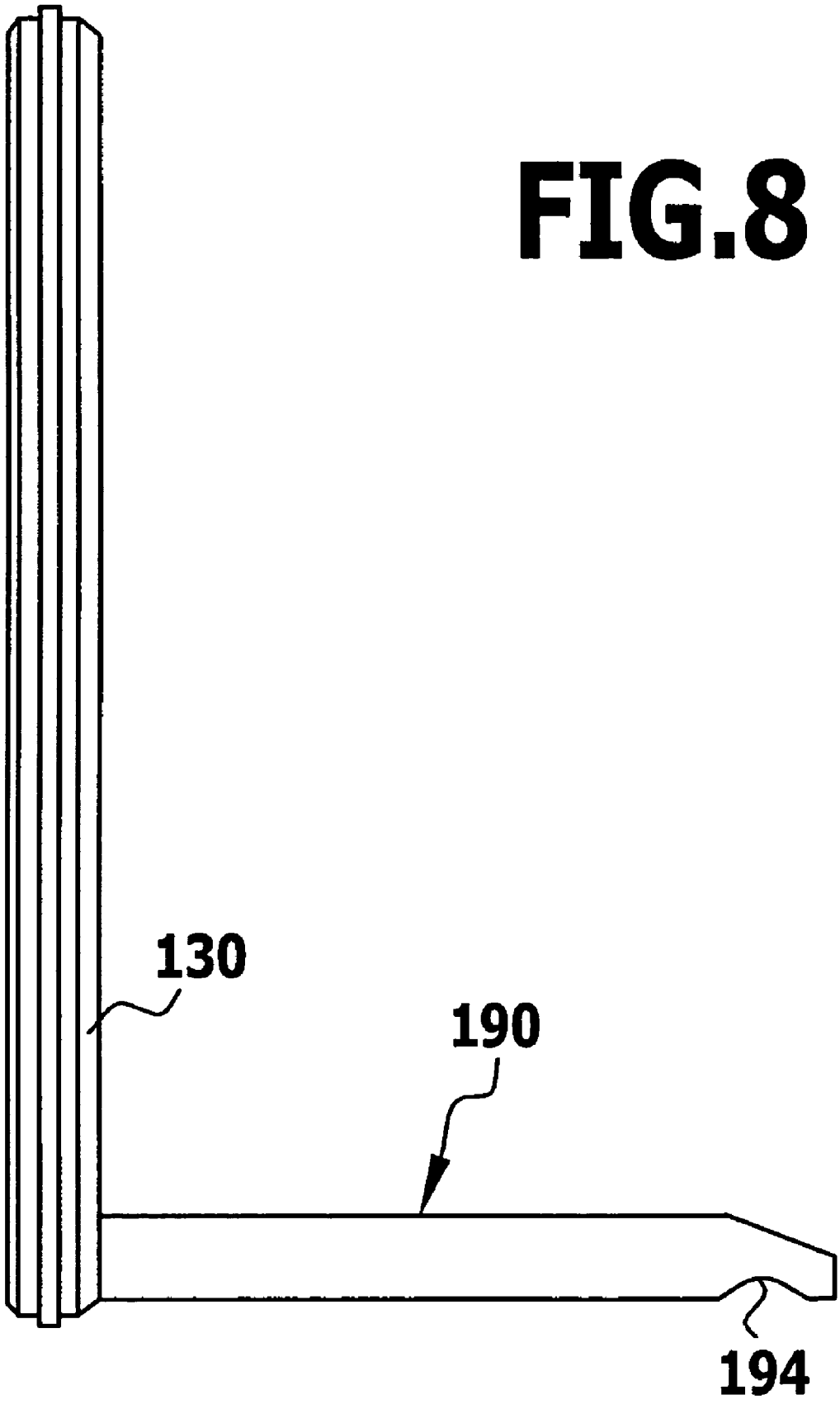
FIG. 8 shows an enlarged side view of a partition with lubricant-receiving tube.

By way of example, the opening 194, as illustrated in FIG. 8, is disposed on a side facing the base side 196, in order to be able to receive lubricant collecting directly above this side without gaseous refrigerant being received together with this lubricant.

Figure 9:
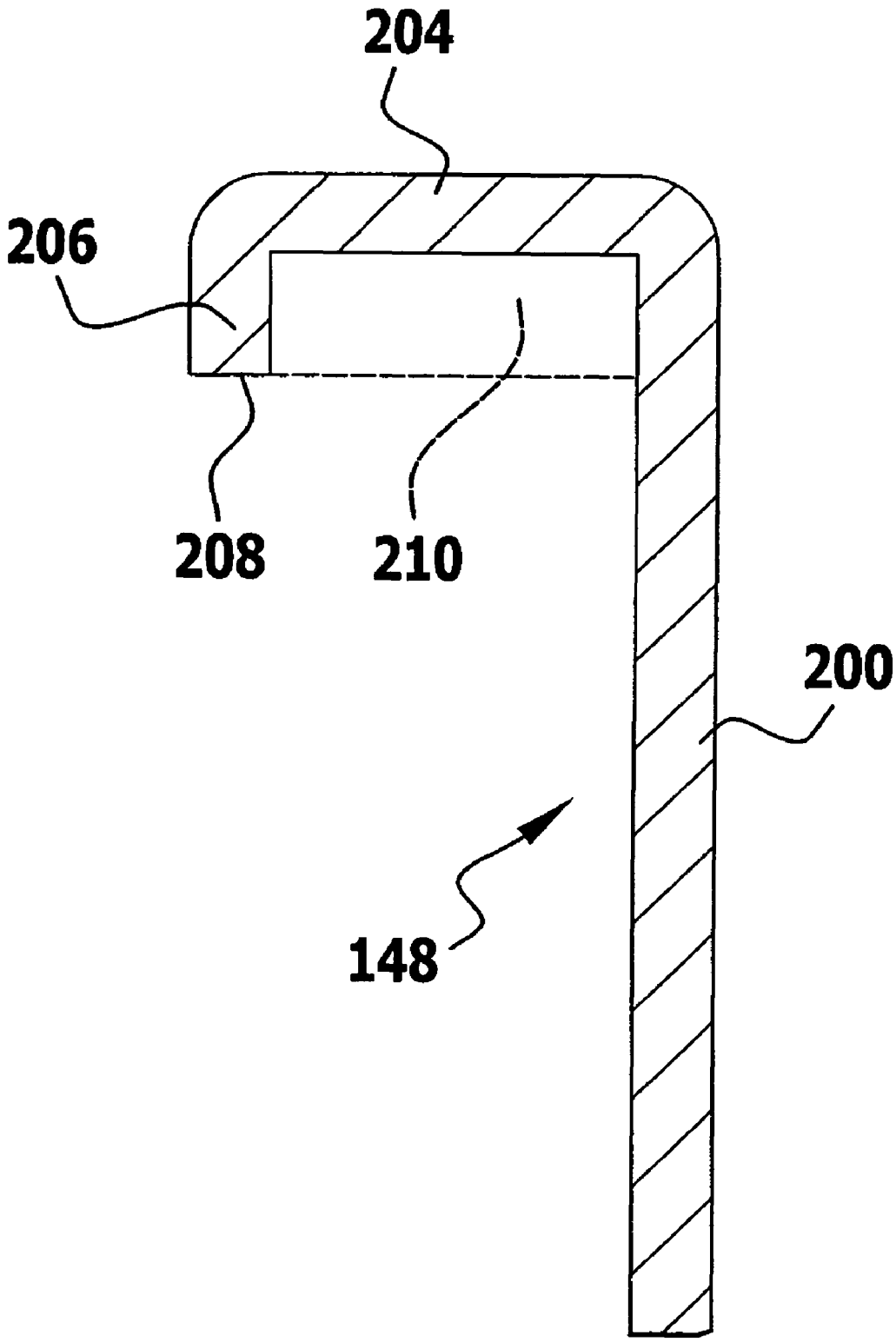
FIG. 9 shows a partial section corresponding to FIG. 2 through a delivery wheel in a radially outer region.

In the simplest case, the delivery wheel 142 may be formed simply by the delivery disk 148. However, an advantageous solution provides that the delivery disk 148, which, as illustrated in FIG. 2, extends in a disk plane 202 extending perpendicular to the center axis 34, is provided with a radially outer channel-like outer edge 200, which has an outer flange region 204 extending transversely with respect to the disk plane 202 and, as illustrated in FIG. 9, merges into a radially inwardly projecting annular region 206 which ends in an annular inner edge 208.

Therefore, the lubricant delivered by the delivery wheel 142 can be collected through centrifugal force in an outer annular space 210, which the lubricant, on account of centrifugal force, initially leaves in a centrifugal space 154 located above the center axis 34, as seen in the direction of the force of gravity, in order to be thrown onto the catcher walls 156, which then pass the lubricant to the feed space 158.

In order to make the lubricant enter the lubricant-receiving tube 190 through the opening 194 and flow through this tube into the lubricant delivery space 150, with the lubricant then collecting in the delivery sump 152, the lubricant delivery space 150 is held at a static pressure level which is lower than the static pressure level in the lubricant collection space 124.

The static pressure level in the lubricant collection space 124 corresponds to the pressure level in the intermediate space 80, and the static pressure level in the intermediate space 80 is higher than the static pressure level in the suction space 110, since the refrigerant which has been sucked in and passes from the intermediate space 80 into the suction space 110 has to flow through the through-openings 102 and 104.

Figure 3:
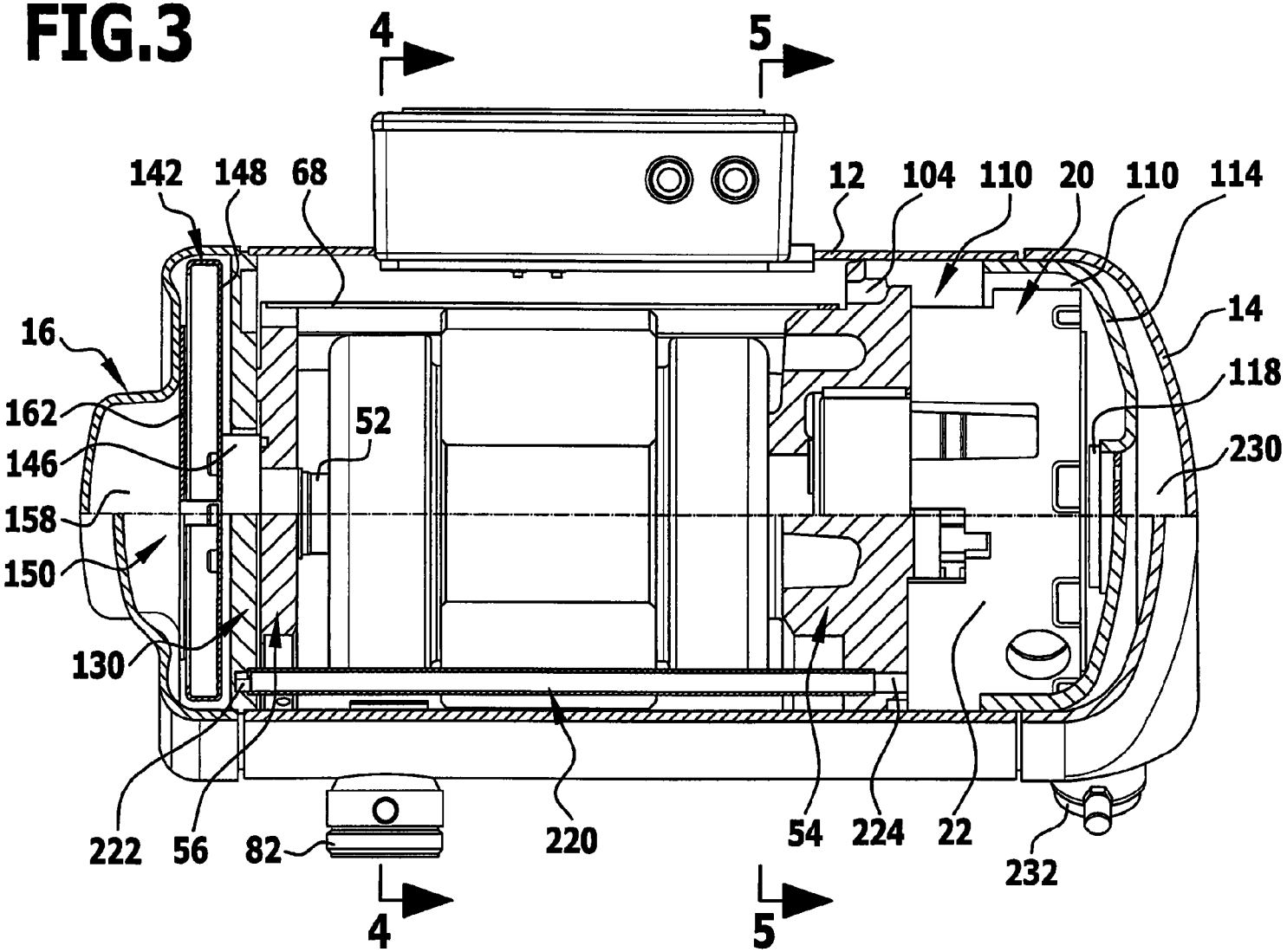
FIG. 3 shows a section on line 3-3 in FIG. 1.
Figure 4:
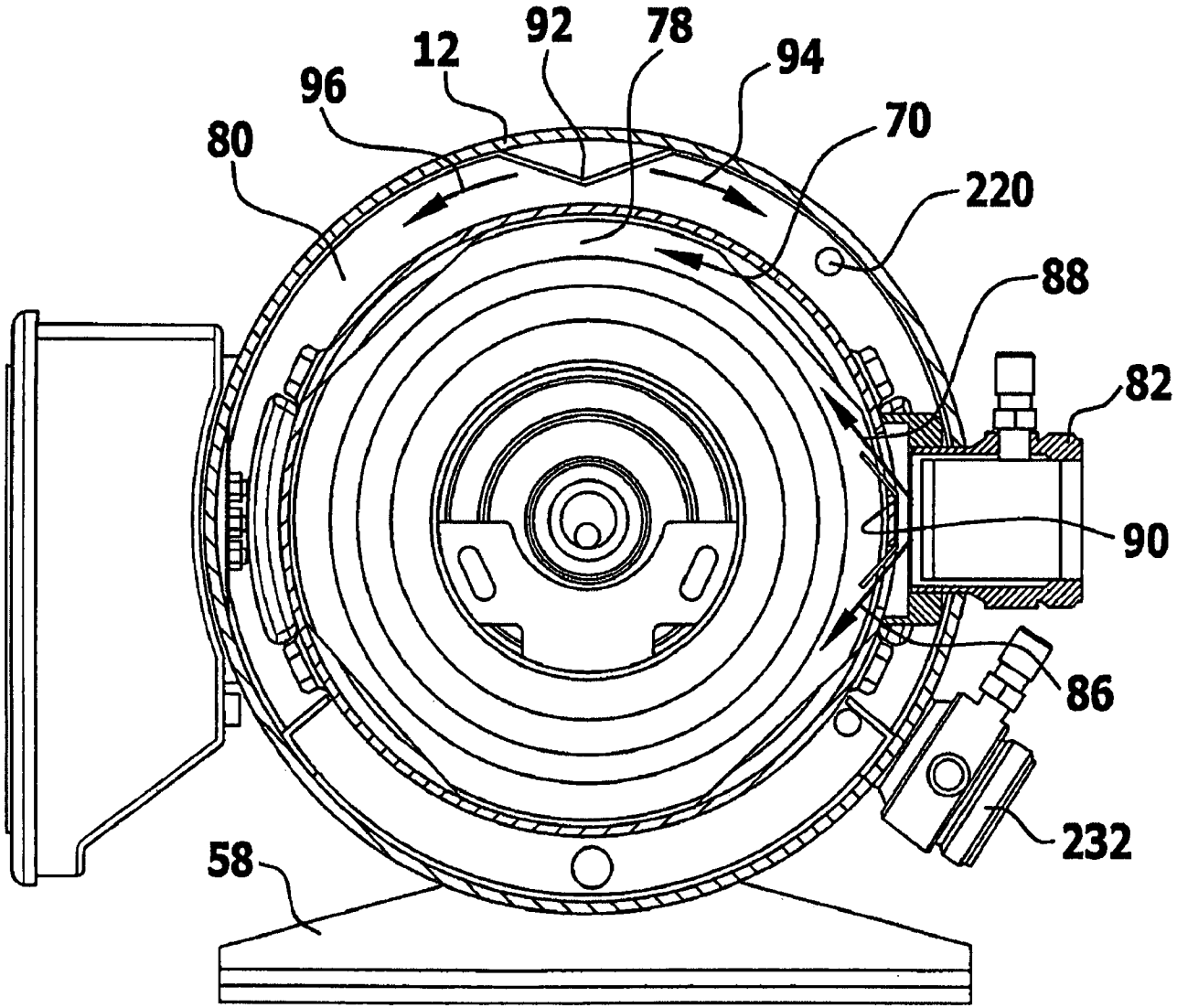
FIG. 4 shows a section on line 4-4 in FIG. 3.

For this reason, the static pressure level in the lubricant delivery space 150 is lowered with respect to the pressure level in the lubricant collection space 124, specifically by a connecting line 220, which is illustrated in FIG. 3, passes through the partition 130 and extends from an opening 222 opening out into the lubricant delivery space 150 to an opening 224 opening out into the suction space 110, so that this connecting line 220 can effect pressure equalization between the lubricant delivery space 150 and the suction space 110, and therefore the static pressure in the lubricant delivery space 150 can be kept at a lower level than in the lubricant collection space 124. It is preferable for the static pressure in the lubricant delivery space 150 to be slightly above the static pressure in the suction space 10, so that as a result, on account of the pressure difference, the lubricant always flows into the lubricant delivery space 150 and forms, in the latter, the delivery sump 152, from which the lubricant is then delivered into the feed space 158 by the delivery wheel 142.

In the refrigerant compressor according to the invention, it is preferable for the compressed refrigerant to collect in a high-pressure space 230, which is located between the intermediate base 114 and the first cover 14, and to pass out of this high-pressure space 230 through a high-pressure connection 232.

In a second exemplary embodiment of a refrigerant compressor according to the invention, those elements which are identical to those of the first exemplary embodiment are denoted by the same reference numbers, and in this respect reference is made in full to the description of these elements in connection with the first exemplary embodiment.

Figure 10:
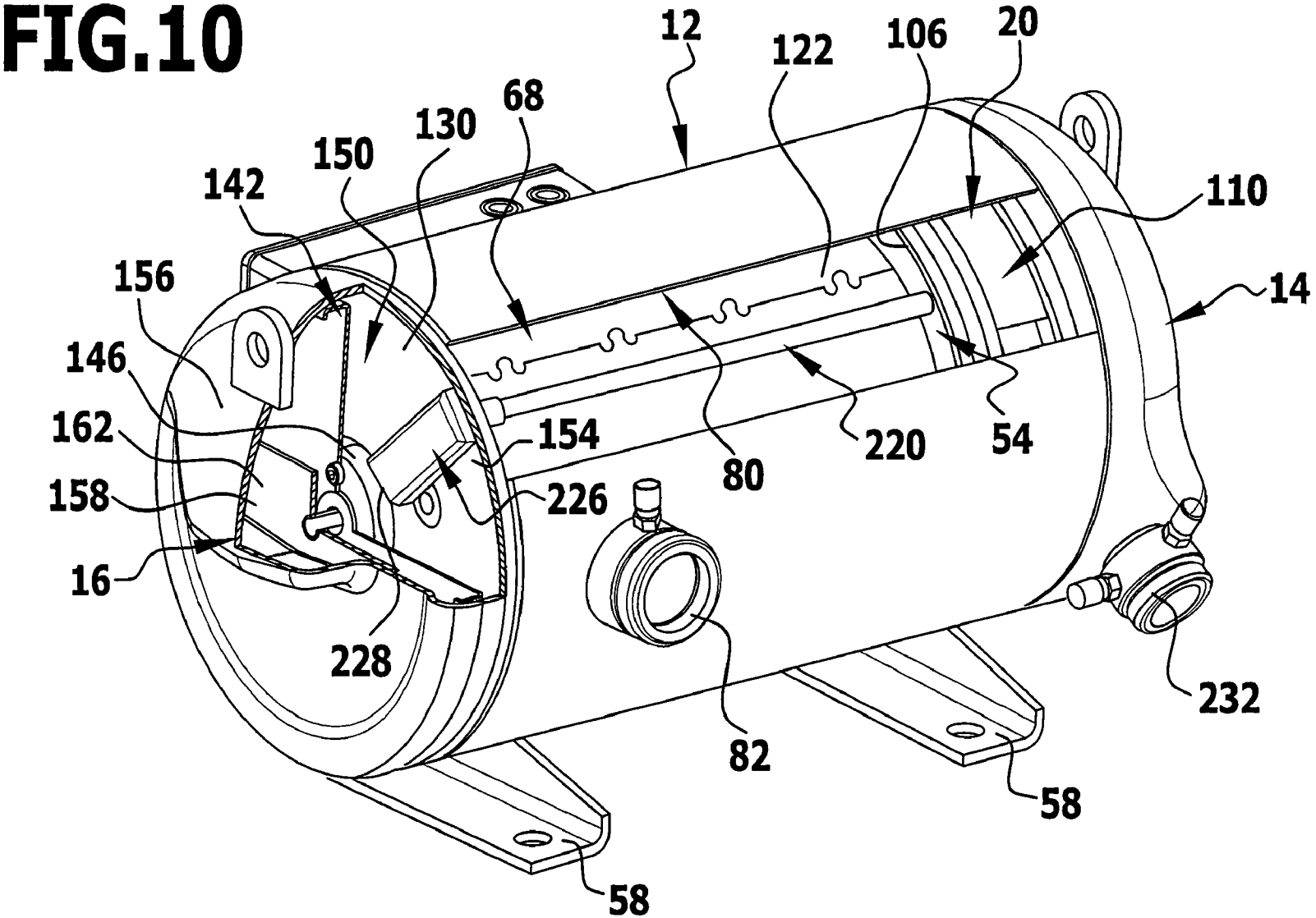
FIG. 10 shows a perspective illustration similar to FIG. 1 of a second exemplary embodiment of a compressor according to the invention.

Unlike in the first exemplary embodiment, in the second exemplary embodiment, illustrated in FIG. 10, the opening 222 which opens out into the lubricant delivery space 150 is covered by a hood 226, which forms a channel which starts from the opening 222, runs along the partition 130 and has an opening 228, which faces the hub 146 of the delivery wheel 142 and through which, on account of the lower static pressure in the suction space 110, gas is sucked out of the lubricant delivery space 150 via the channel formed by the hood 226 and via the connecting line 220. The hood 226 has the advantage that therefore it is not gas from the lubricant delivery space 150, which contains a very high level of lubricant droplets and/or lubricant mist, which is received in the region of the centrifugal space 154, but rather gas from a region of the lubricant delivery space 150 which is located close to the hood 146 and in which the level of lubricant droplets and lubricant mist is lower.

Otherwise, the second exemplary embodiment is formed in the same way as the first exemplary embodiment, and consequently reference can be made in full to the statements made in connection with the first exemplary embodiment.

The invention claimed is:

1. A compressor for refrigerant comprising:

an outer casing, a scroll compressor disposed in the outer casing and has a first compressor body disposed in a fixed position in the outer casing and a second compressor body that can move relative to the first compressor body, wherein the first and second compressor bodies have first and second bases, respectively, the first and second compressor bodies having first and second scroll fins, respectively, which project from the respective base and engage into one another in such a way that to compress the refrigerant the second compressor body is movable with respect to the first compressor body on an orbital path about a center axis, a drive unit disposed in the outer casing for the second compressor body and having an eccentric drive, a drive shaft running in lying arrangement in the outer casing, a drive motor including a stator and a rotor seated on the drive shaft, a lubricant supply, the lubricant supply having a delivery wheel which delivers lubricant from a delivery sump into a feed space for the drive shaft, a lubricant collection space disposed in the outer casing, a lubricant delivery space accommodating the delivery sump, wherein a lower pressure prevailing in the lubricant delivery space is kept below a pressure in the lubricant collection space due to a connection passage between the lubricant delivery space and a suction space of the scroll compressor, wherein the lubricant which collects in the lubricant collection space on account of the pressure difference, passes into the delivery sump;

wherein a lower static pressure prevails in the suction space of the scroll compressor than in the lubricant collection space, wherein a connecting line defines the connection passage and leads from the suction space of the scroll compressor to the lubricant delivery space wherein the connecting line is directed through a lubricant separation space.

2. Compressor according to claim 1, wherein the lubricant supply is disposed on the opposite side of the drive motor from the scroll compressor.

3. Compressor according to claim 1, wherein the lubricant delivery space is disposed between a partition in the outer casing and an end wall of the outer casing.

4. Compressor according to claim 1, wherein the feed space for the lubricant supply is disposed at an end wall of the outer casing.

5. Compressor according to claim 4, wherein the feed space is at least partially formed into the end wall of the outer casing.

6. Compressor according to claim 1, wherein the delivery sump is enclosed by an end wall of the outer casing and by a partition.

7. Compressor according to claim 6, wherein the end wall carries the feed space, and wherein the delivery sump is disposed between the end wall of the outer casing and the partition.

8. Compressor according to claim 3, wherein the partition has a passage for lubricant to pass from the lubricant collection space into the delivery sump.

9. Compressor according to claim 8, wherein the passage comprises a lubricant collection tube which is directed to a base side of the lubricant collection space.

10. Compressor according to claim 9, wherein the lubricant collection tube extends as far as a central region of the lubricant collection space.

11. Compressor according to claim 9, wherein the base side of the lubricant collection space runs approximately parallel to a center axis of the drive shaft.

12. Compressor according to claim 9, wherein the lubricant collection tube has an inlet opening facing the base side.

13. Compressor according to claim 1, wherein the delivery wheel has an edge region extending transversely with respect to a disk plane of the delivery wheel.

14. Compressor according to claim 13, wherein the edge region is of channel-like form.

15. Compressor according to claim 1, wherein a partition carries a bearing unit of the drive motor.

16. Compressor according to claim 1, wherein the lubricant separation space, through which sucked-in refrigerant flows before it enters the scroll compressor, is provided in the outer casing.

17. Compressor according to claim 16, wherein the lubricant separation space is disposed between the drive motor and the outer casing.

18. Compressor according to claim 1, wherein the drive motor is provided with a flow-guiding jacket which directs refrigerant through the drive motor for cooling purposes.

19. Compressor according to claim 18, wherein refrigerant that has been sucked in and is to be compressed enters a motor inner space surrounded by the flow-guiding jacket.

20. Compressor according to claim 18, wherein the refrigerant emerges from the flow-guiding jacket into the lubricant separation space.

21. Compressor according to claim 20, wherein the lubricant separation space is disposed between the flow-guiding jacket and the outer casing.

22. Compressor according to claim 1, wherein the lubricant collection space is disposed between the drive motor and the outer casing.

23. Compressor according to claim 18, wherein the lubricant collection space is disposed in an intermediate space between the flow-guiding jacket of the drive motor and the outer casing.

24. Compressor according to claim 23, wherein the lubricant separation space, through which sucked-in refrigerant flows before it enters the scroll compressor, is provided in the outer casing; wherein the lubricant separation space is disposed in the intermediate space between the flow-guiding jacket and the outer casing, above the lubricant collection space with regard to the direction of the force of gravity.

25. Compressor according to claim 1, wherein the refrigerant passes from the lubricant separation space into the suction space of the scroll compressor.

26. Compressor according to claim 1, wherein the drive shaft is supported by a first bearing unit which is disposed between the scroll compressor and the drive motor.

27. Compressor according to claim 26, wherein the first bearing unit is supported in the outer casing.

28. Compressor according to claim 27, wherein the lubricant separation space, through which sucked-in refrigerant flows before it enters the scroll compressor, is provided in the outer casing; wherein through-openings for the refrigerant to be passed from the lubricant separation space into the suction space of the scroll compressor are provided in the first bearing unit.

29. Compressor according to claim 28, wherein the drive shaft is supported by a second bearing unit which is disposed on the opposite side of the drive motor from the first bearing unit.

30. Compressor according to claim 29, wherein the lubricant separation space is located between the first and second bearing units.

31. Compressor according to claim 29, wherein the lubricant collection space is located between the first and second bearing units.

* * * * *